US011473178B2

(12) United States Patent
Yu et al.

(10) Patent No.: US 11,473,178 B2
(45) Date of Patent: *Oct. 18, 2022

(54) WEAR-RESISTANT STEEL HAVING EXCELLENT HARDNESS AND IMPACT TOUGHNESS, AND METHOD FOR PRODUCING SAME

(71) Applicant: POSCO, Pohang-si (KR)

(72) Inventors: Seng-Ho Yu, Pohang-si (KR); Young-Jin Jung, Pohang-si (KR); Yong-Woo Kim, Pohang-si (KR)

(73) Assignee: POSCO, Pohang-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/955,656

(22) PCT Filed: Dec. 21, 2018

(86) PCT No.: PCT/KR2018/016525

§ 371 (c)(1),
(2) Date: Jun. 18, 2020

(87) PCT Pub. No.: WO2019/125076

PCT Pub. Date: Jun. 27, 2019

(65) Prior Publication Data

US 2020/0385846 A1 Dec. 10, 2020

(30) Foreign Application Priority Data

Dec. 22, 2017 (KR) ..... 10-2017-0178821

(51) Int. Cl.

| | |
|---|---|
| ***C22C 38/52*** | (2006.01) |
| ***C21D 8/02*** | (2006.01) |
| ***C21D 9/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |

(52) U.S. Cl.

CPC ..... *C22C 38/52* (2013.01); *C21D 8/021* (2013.01); *C21D 8/0205* (2013.01); *C21D 8/0226* (2013.01); *C21D 9/0081* (2013.01); *C22C 38/002* (2013.01); *C22C 38/008* (2013.01); *C22C 38/02* (2013.01); *C22C 38/04* (2013.01); *C22C 38/06* (2013.01); *C22C 38/44* (2013.01); *C22C 38/48* (2013.01); *C22C 38/50* (2013.01); *C21D 2211/002* (2013.01); *C21D 2211/008* (2013.01)

(58) Field of Classification Search

CPC ..... C21D 1/18; C21D 2211/002; C21D 2211/008; C21D 6/00; C21D 6/004; C21D 8/0205; C21D 8/0226; C22C 38/02; C22C 38/04; C22C 38/52

USPC ..... 420/107

See application file for complete search history.

(56) References Cited

U.S. PATENT DOCUMENTS

| | | | | |
|---|---|---|---|---|
| 8,500,924 | B2 * | 8/2013 | Kumagai | C21D 8/0205 148/330 |
| 9,938,599 | B2 * | 4/2018 | Ueda | C22C 38/06 |
| 2006/0162823 | A1 | 7/2006 | Omori et al. | |
| 2011/0253271 | A1 * | 10/2011 | Kumagai | C21D 8/02 148/645 |
| 2014/0096875 | A1 * | 4/2014 | Ueda | C22C 38/40 148/645 |
| 2015/0225822 | A1 | 8/2015 | Miura et al. | |
| 2016/0208352 | A1 | 7/2016 | Suikkanen et al. | |
| 2018/0073116 | A1 | 3/2018 | Zhao et al. | |
| 2018/0237875 | A1 | 8/2018 | Im et al. | |
| 2019/0390293 | A1 * | 12/2019 | Yu | C22C 38/44 |

FOREIGN PATENT DOCUMENTS

| | | | |
|---|---|---|---|
| CN | 1782117 | A | 11/2005 |
| CN | 101182622 | A | 5/2008 |
| CN | 101250673 | A | 8/2008 |
| CN | 101353763 | A | 1/2009 |

(Continued)

OTHER PUBLICATIONS

NPL: on-line translation of JP-09118950-A May 1997 (Year: 1997).*

(Continued)

*Primary Examiner* — Jie Yang

(74) *Attorney, Agent, or Firm* — Morgan, Lewis & Bockius LLP

(57) ABSTRACT

The present disclosure relates to wear-resistant steel comprising, by weight, carbon (C): 0.19 to 0.28%, silicon (Si): 0.1 to 0.7%, manganese (Mn): 0.6 to 1.6%, phosphorus (P): 0.05% or less, sulfur (S): 0.02% or less, aluminum (Al): 0.07% or less, chromium (Cr): 0.01 to 0.5%, nickel (Ni): 0.01 to 3.0%, copper (Cu): 0.01 to 1.5%, molybdenum (Mo): 0.01 to 0.5%, boron (B): 50 ppm or less, and cobalt (Co): 0.02% or less, further comprising one or more selected from the group consisting of titanium (Ti): 0.02% or less, niobium (Nb): 0.05% or less, vanadium (V): 0.05% or less, and calcium (Ca): 2 to 100 ppm, and comprising a remainder of iron (Fe) and other unavoidable impurities, wherein C, Ni, and Cu satisfy the following relationship 1, wherein a microstructure includes 97 area % or more of martensite:

$$C \times Ni \times Cu \geq 0.05. \quad \text{[Relationship 1]}$$

8 Claims, No Drawings

(56) References Cited

FOREIGN PATENT DOCUMENTS

| | | | | |
|---|---|---|---|---|
| CN | 101775539 | A | | 7/2010 |
| CN | 102936693 | A | | 2/2013 |
| CN | 103352167 | A | | 10/2013 |
| CN | 104789892 | A | | 7/2015 |
| EP | 2692890 | A1 | | 2/2014 |
| EP | 2881482 | A1 | | 6/2015 |
| JP | S61-166954 | A | | 7/1986 |
| JP | H08-41535 | A | | 2/1996 |
| JP | 09118950 | A | * | 5/1997 |
| JP | H09-118950 | A | | 5/1997 |
| JP | 2002-212628 | A | | 7/2002 |
| JP | 2005-256169 | A | | 9/2005 |
| JP | 2007-92155 | A | | 4/2007 |
| JP | 2007119850 | A | * | 5/2007 |
| JP | 2011-214120 | A | | 10/2011 |
| JP | 2012-148310 | A | | 8/2012 |
| JP | 2015-200015 | A | | 11/2015 |
| JP | 2016-79459 | A | | 5/2016 |
| KR | 10-0702491 | B1 | | 4/2007 |
| KR | 10-2012-0053616 | A | | 5/2012 |
| KR | 10-2012-0071614 | A | | 7/2012 |
| KR | 10-2014-0119868 | A | | 10/2014 |
| KR | 10-2014-0137942 | A | | 12/2014 |
| KR | 10-2015-0036798 | A | | 4/2015 |
| KR | 10-2016-0072099 | A | | 6/2016 |
| KR | 10-1696094 | B1 | | 1/2017 |
| KR | 10-2018-0073368 | A | | 7/2018 |

OTHER PUBLICATIONS

NPL: on-line translation of JP-2007119850-A, May 2007 (Year: 2007).*

Extended European Search Report dated Aug. 10, 2020 issued in European Patent Application No. 18891621.7.

Chinese Office Action dated Jun. 3, 2021 issued in Chinese Patent Application No. 201880082571.0 (with English translation).

X. Yang, "Research on Heat Treatment Process of Wear-Resistant Casting Steel having High Strength and Toughness," Silicon Valley, No. 6, vol. 7, 2013 (with English translation).

International Search Report issued in corresponding International Application No. PCT/KR2018/016525 dated Apr. 1, 2019, with English translation.

Chinese Office Action dated Jan. 20, 2022 issued in Chinese Patent Application No. 201880082571.0 (with English translation).

* cited by examiner

WEAR-RESISTANT STEEL HAVING EXCELLENT HARDNESS AND IMPACT TOUGHNESS, AND METHOD FOR PRODUCING SAME

CROSS REFERENCE

This application is the U.S. National Phase under 35 U.S.C. § 371 of International Application No. PCT/KR2018/016525 filed on Dec. 21, 2018, which claims the benefit of Korean Application No. 10-2017-0178821 filed on Dec. 22, 2017, the entire contents of each are hereby incorporated by reference.

TECHNICAL FIELD

The present disclosure relates to a wear-resistant steel having high hardness, and a method for producing the same, and more particularly, to a wear-resistant steel having high hardness, and a method for producing the same, used in construction machines and the like.

BACKGROUND ART

In the case of construction machines and industrial machines used in many industrial fields, such as construction, civil engineering, the mining industry, the cement industry, and the like, as severe wear may be caused by friction during working, the use of a material exhibiting characteristics of wear resistance may be required.

In general, wear resistance and hardness of a thick steel sheet may be correlated with each other. Thus, in the case of a thick steel sheet in which may be worn down, it may be necessary to increase hardness of the thick steel sheet. To ensure more stable wear resistance, it may be necessary to have uniform hardness (for example, to have the same degree of hardness on a surface and in an inside of a thick steel sheet) from the surface of a thick steel sheet through the inside of a plate thickness (t/2 vicinity, t=a thickness).

Generally, to obtain high hardness in a thick steel sheet, a method of reheating to an Ac3 temperature or higher after rolling and then performing quenching may be widely used. For example, Patent Documents 1 and 2 disclose a method of increasing surface hardness by increasing a C content and adding a large amount of elements for improving hardenability, such as Cr, Mo and the like. However, to manufacture an ultra-thick steel sheet, it may be necessary to add more hardenable elements to secure hardenability of a central portion of a steel sheet. In this case, as large amounts of C and hardenable alloy may be added, there may be a problem in which manufacturing costs may be increased and weldability and low temperature toughness may be lowered.

Therefore, there may be demand for a method capable of ensuring high strength and high impact toughness as well as securing excellent wear resistance by securing high hardness in the situation in which the addition of a hardenable alloy may be inevitable to secure hardenability.

(Patent Document 1) Japanese Patent Laid-Open Publication No. 1996-041535

(Patent Document 2) Japanese Patent Laid-Open Publication No. 1986-166954.

DISCLOSURE

Technical Problem

An aspect of the present disclosure is to provide a wear-resistant steel having high hardness, as well as having high strength and impact toughness, and to a method for producing the same.

Technical Solution

According to an aspect of the present disclosure, a high-hardness wear-resistant steel includes, by weight, carbon (C): 0.19 to 0.28%, silicon (Si): 0.1 to 0.7%, manganese (Mn): 0.6 to 1.6%, phosphorus (P): 0.05% or less (excluding 0%), sulfur (S): 0.02% or less (excluding 0%), aluminum (Al): 0.07% or less (excluding 0%), chromium (Cr): 0.01 to 0.5%, nickel (Ni): 0.01 to 3.0%, copper (Cu): 0.01 to 1.5%, molybdenum (Mo): 0.01 to 0.5%, boron (B): 50 ppm or less (excluding 0%), and cobalt (Co): 0.02% or less (excluding 0%), further comprising one or more selected from the group consisting of titanium (Ti): 0.02% or less (excluding 0%), niobium (Nb): 0.05% or less (excluding 0%), vanadium (V): 0.05% or less (excluding 0%), and calcium (Ca): 2 to 100 ppm, and comprising a remainder of iron (Fe) and other unavoidable impurities, wherein C, Ni, and Cu satisfy the following relationship 1, wherein a microstructure includes 97 area % or more of martensite:

$$C \times Ni \times Cu \geq 0.05 \quad \text{[Relationship 1]}$$

Where the contents of C, Ni, and Cu are based on wt %.

According to another aspect of the present disclosure, a method for producing wear-resistant steel having excellent hardness and impact toughness, comprising: heating a steel slab at a temperature ranging from 1050 to 1250° C., the steel slab comprising, by weight, carbon (C): 0.19 to 0.28%, silicon (Si): 0.1 to 0.7%, manganese (Mn): 0.6 to 1.6%, phosphorus (P): 0.05% or less (excluding 0%), sulfur (S): 0.02% or less (excluding 0%), aluminum (Al): 0.07% or less (excluding 0%), chromium (Cr): 0.01 to 0.5%, nickel (Ni): 0.01 to 3.0%, copper (Cu): 0.01 to 1.5%, molybdenum (Mo): 0.01 to 0.5%, boron (B): 50 ppm or less (excluding 0%), and cobalt (Co): 0.02% or less (excluding 0%), further comprising one or more selected from the group consisting of titanium (Ti): 0.02% or less (excluding 0%), niobium (Nb): 0.05% or less (excluding 0%), vanadium (V): 0.05% or less (excluding 0%), and calcium (Ca): 2 to 100 ppm, and comprising a remainder of iron (Fe) and other unavoidable impurities, wherein C, Ni, and Cu satisfy the following relationship 1; rough-rolling the heated steel slab, in a temperature range of 950 to 1050° C. to obtain a rough-rolled bar; finish-rolling the rough-rolled bar in a temperature range of 850 to 950° C. to obtain a hot-rolled steel sheet; air-cooling the hot-rolled steel sheet to room temperature, and then, reheating the hot-rolled steel sheet at a temperature ranging from 880 to 930° C. in a furnace time of 1.3t+10 minutes to 1.3t+60 minutes (t: a plate thickness); and water-cooling the reheated and hot-rolled steel sheet to 150° C. or lower:

$$C \times Ni \times Cu \geq 0.05 \quad \text{[Relationship 1]}$$

Where the contents of C, Ni, and Cu are based on wt %.

Advantageous Effects

According to an embodiment of the present disclosure, wear-resistant steel having high hardness and excellent low temperature toughness and having a thickness of 60 mm or less may be provided.

BEST MODE FOR INVENTION

Hereinafter, the present disclosure will be described in detail. First, the alloy composition of the present disclosure will be described. The content of the alloy composition described below may be based on wt %.

C: 0.19 to 0.28%.

Carbon (C) may be effective for increasing strength and hardness in steel with martensite structure, and may be an element effective in improving hardenability. To sufficiently secure the above-mentioned effect, the content of C may be 0.19% or more. When the content thereof exceeds 0.28% there may be a problem in which weldability and toughness are deteriorated, and an additional heat treatment operation such as tempering is inevitable. Therefore, according to an embodiment in the present disclosure, the C content may be controlled to be within a range of 0.19 to 0.288%. A lower limit of the C content is more preferably 0.20%, even more preferably 0.21%, and most preferably 0.22%. An upper limit of the C content is more preferably 0.275%, even more preferably 0.27%, and most preferably 0.265%.

Si: 0.1 to 0.7%.

Silicon (Si) may be an element effective in improving strength by deoxidation and solid solution strengthening. To obtain the above-mentioned effect, Si may be added in an amount of 0.1% or more. When the content thereof exceeds 0.7%, weldability may deteriorate. Therefore, according to an embodiment in the present disclosure, the Si content may be controlled to be within a range of 0.1 to 0.7%. A lower limit of the Si content is more preferably 0.12%, even more preferably 0.15%, and most preferably 0.18%. An upper limit of the Si content is more preferably 0.65%, even more preferably 0.60%, and most preferably 0.50%.

Mn: 0.6 to 1.6%.

Manganese (Mn) may be an element which suppresses ferrite formation and lowers the Ar3 temperature, to effectively increase quenching properties and improve strength and toughness of steel. In an embodiment in the present disclosure, the Mn content may be 0.6% or more to secure hardness of a thick steel sheet. When the content thereof exceeds 1.6%, weldability may be deteriorated. Therefore, according to an embodiment in the present disclosure, the Mn content may be controlled to be within a range of 0.6 to 1.6%. A lower limit of the Mn content is more preferably 0.62%, even more preferably 0.65%, and most preferably 0.70%. An upper limit of the Mn content is more preferably 1.55%.

P: 0.05% or less (excluding 0%).

Phosphorus (P) may be an element that is inevitably contained in steel and deteriorates toughness of the steel. Therefore, the P content may be controlled to be 0.05% or less by significantly reducing the P content, and 0% may be excluded considering the level that may be inevitably contained.

S: 0.02% or less (excluding 0%).

Sulfur (S) may be an element which deteriorates toughness of steel by forming MnS inclusions in steel. Therefore, the S content may be controlled to be 0.02% or less by significantly reducing the S content, and 0% may be excluded considering the level that may be inevitably contained.

Al: 0.07% or less (excluding 0%%).

Aluminum (Al) may be a deoxidizing agent for steel and may be an element effective in lowering oxygen content in molten steel. When the Al content exceeds 0.07%, there may be a problem in which cleanliness of steel may be deteriorated. Therefore, according to an embodiment in the present disclosure, the Al content may be controlled to be 0.07% or less, and 0% may be excluded in consideration of an increase of load and manufacturing costs in a steel making process.

Cr: 0.01 to 0.5%.

Chromium (Cr) may be an element which increases quenching properties to increase strength of steel and is favorable for securing hardness. To obtain the above-mentioned effect, Cr may be added in an amount of 0.01% or more. When the content thereof exceeds 0.5%, weldability may deteriorate and manufacturing costs may be increased. A lower limit of the Cr content is more preferably 0.03%, even more preferably 0.05%, and most preferably 0.1%. An upper limit of the Cr content is more preferably 0.47%, even more preferably 0.45%, and most preferably 0.40%.

Ni: 0.01 to 3.0%.

Nickel (Ni) may be an element effective in improving toughness as well as strength of steel. To obtain the above-mentioned effect, Ni may be added in an amount of 0.01% or more. When the content thereof exceeds 3.0%, it may cause an increase in manufacturing cost due to an expensive element. A lower limit of the Ni content is more preferably 0.03%, even more preferably 0.05%, and most preferably 0.10%. An upper limit of the Ni content is more preferably 2.95%, even more preferably 2.9%, and most preferably 2.85%.

Copper (Cu): 0.01 to 1.5%.

Copper (Cu) may be an element that may simultaneously increase strength and toughness of steel, together with Ni. In order to obtain the above effect, Cu may be added in an amount of 0.01% or more. When the content of Cu exceeds 1.5%, there may be problems that possibility of surface defects may be increased and hot-roll workability may be deteriorated. Therefore, according to an embodiment in the present disclosure, the Cu content may be controlled to be within a range of 0.01 to 1.5%. A lower limit of the Cu content is more preferably 0.03%, more preferably 0.05%, and most preferably 0.10%. An upper limit of the Cu content is more preferably 1.45%, more preferably 1.43%, and most preferably 1.4%.

Mo: 0.01 to 0.5%.

Molybdenum (Mo) may be an element that increases quenching properties of steel, and is especially effective in improving hardness of a thick steel sheet. To sufficiently obtain the above-mentioned effect, Mo may be added in an amount of 0.01% or more. Since Mo is also an expensive element, and when the content thereof exceeds 0.5%, manufacturing costs may be increased and weldability may be deteriorated. A lower limit of the Mo content is more preferably 0.03%, and even more preferably 0.05%. An upper limit of the Mo content is more preferably 0.48%, and even more preferably 0.45%.

B: 50 ppm or less (excluding 0%).

Boron (B) may be an element effective in increasing quenching properties of steel even when added in a relatively small amount to improve strength. When the content thereof is excessive, toughness and weldability of steel may be deteriorated. Therefore, the content thereof may be controlled to 50 ppm or less. The B content is more preferably 40 ppm or less, even more preferably 35 ppm or less, and most preferably 30 ppm or less.

Co: 0.02% or less (excluding 0%%).

Cobalt (Co) may be an element favorable for securing hardness together with strength of steel by increasing quenching properties of the steel. When the content thereof exceeds 0.02%, quenching properties of the steel may be lowered, and manufacturing costs may be increased by an expensive element. Therefore, according to an embodiment in the present disclosure, Co may be added in an amount of 0.02% or less. The Co content is more preferably 0.018% or less, even more preferably 0.015% or less, and most preferably 0.013% or less.

Wear-resistant steel according to an embodiment in the present disclosure may further include, in addition to the alloy composition described above, elements which may be to secure physical properties required according to an embodiment in the present disclosure. For example, the wear-resistant steel may further include one or more selected from the group consisting of titanium (Ti): 0.02% or less (excluding 0%), niobium (Nb): 0.05% or less (excluding 0%), vanadium (V): 0.05% or less (excluding 0%), and calcium (Ca): 2 to 100 ppm.

Ti: 0.02% or less (excluding 0%%).

Titanium (Ti) may be an element that maximizes the effect of B, an element effective in improving quenching properties of steel. In detail, Ti may be bonded to nitrogen (N) to form TiN precipitates, to suppress formation of BN, and may, thus, increase solid solution B to significantly increase improvement of quenching properties. When the content of Ti exceeds 0.02%, coarse TiN precipitates may be formed to deteriorate toughness of the steel. Therefore, according to an embodiment in the present disclosure, when Ti may be added, Ti may be added in an amount of 0.02% or less. The Ti content is more preferably 0.019% or less, even more preferably 0.018% or less, and most preferably 0.017% or less.

Nb: 0.05% or less (excluding 0%%).

Niobium (Nb) may be solidified in austenite to increase hardenability of austenite, and to form carbonitride such as Nb(C,N) or the like, which may be effective in increasing strength of steel and inhibiting austenite grain growth. When the content of Nb exceeds 0.05%, coarse precipitates may be formed, which may be a starting point of brittle fracture, to deteriorate toughness. Therefore, according to an embodiment in the present disclosure, when Nb is added, Nb may be added in an amount of 0.05% or less. The Nb content is more preferably 0.045% or less, even more preferably 0.04% or less, and most preferably 0.03% or less.

V: 0.05% or less (excluding 0%%).

Vanadium (V) may be an element which may be advantageous for suppressing growth of austenite grains, by forming VC carbides upon reheating after hot-rolling, and improving quenching properties of steel, to secure strength and toughness. Since V is an expensive element, and when the content thereof exceeds 0.05%, manufacturing costs may be increased. Therefore, according to an embodiment in the present disclosure, when V is added, the content of V may be controlled to be 0.05% or less. The V content is more preferably 0.045% or less, even more preferably 0.040% or less, and most preferably 0.035% or less.

Ca: 2 to 100 ppm.

Calcium (Ca) may have an effect of suppressing formation of MnS segregated at the center region of a steel material in a thickness direction, by generating CaS due to strong binding force of Ca with S. In addition, the CaS generated by the addition of Ca may have an effect of increasing corrosion resistance under a high humidity environment. To obtain the above-mentioned effect, Ca may be added in an amount of 2 ppm or more. When the content thereof exceeds 100 ppm, clogging of a nozzle or the like may occur during a steel making operation. Therefore, according to an embodiment in the present disclosure, the Ca content may be controlled to be within a range of 2 to 100 ppm. A lower limit of the Ca content is more preferably 2.5 ppm, more preferably 3 ppm, and most preferably 3.5 ppm. An upper limit of the Ca content is more preferably 80 ppm, even more preferably 60 ppm, and most preferably 40 ppm.

Further, wear-resistant steel according to an embodiment in the present disclosure may further include one or more selected from the group consisting of arsenic (As): 0.05% or less (excluding 0%), tin (Sn): 0.05% or less (excluding 0%), and tungsten (W): 0.05% or less (excluding 0%).

As may be effective for improving toughness of steel, and Sn may be effective for improving strength and corrosion resistance of steel. In addition, W may be an element effective in improving hardness at high temperature in addition to strength improvement by increasing quenching properties. When the contents of As, Sn, and W each exceed 0.05%, not only manufacturing costs increase but also physical properties of the steel may be deteriorated. Therefore, according to an embodiment in the present disclosure, in the case of additionally containing As, Sn, or W, the contents thereof may be controlled to each be 0.05% or less.

The remainder in an embodiment of the present disclosure may be iron (Fe). In an ordinary manufacturing process, impurities which may be not intended may be inevitably incorporated from a raw material or a surrounding environment, and thus, cannot be excluded. These impurities they may be known to any person skilled in the art of manufacturing and thus, may be not specifically mentioned in this specification.

In wear-resistant steel according to an embodiment in the present disclosure, C, Ni, and Cu may satisfy the following relationship 1 among the above-described alloy components. When the following relationship 1 is not satisfied, it may be difficult to simultaneously secure hardness and low-temperature impact toughness proposed by the present disclosure.

$$C \times Ni \times Cu \geq 0.05 \quad \text{[Relationship 1]}$$

Where the contents of C, Ni, and Cu are based on wt %.

A microstructure of wear-resistant steel according to an embodiment in the present disclosure may include martensite as a matrix. In more detail, the wear-resistant steel according to an embodiment in the present disclosure may include martensite with an area fraction of 95% or more (including 100. When the fraction of the martensite is less than 95%, there may be a problem in which it may be difficult to secure required strength and hardness. The microstructure of the wear-resistant steel of the present disclosure may further include 5 area % or less of bainite, to improve low-temperature impact toughness.

In addition, in the present disclosure, it is preferable that the average packet size of the martensite is 20 μm or less. As described above, by controlling the average packet size of martensite to 20 μm or less, hardness and toughness may be simultaneously improved. The average packet size of the martensite is more preferably 15 μm or less, and even more preferably 10 μm or less. The smaller the average packet size of the martensite, the more advantageous it is to secure physical properties. In the present disclosure, an upper limit of the average packet size of the martensite is not particularly limited. In this case, the martensite packet refers to a cluster of lath and block martensite having the same crystal orientation.

The wear-resistant steel of the present disclosure provided as described above may have effects securing a surface hardness of 460 to 540 HB, and having impact absorption energy of 47 J or more at a low temperature of −40° C.

In addition, in the wear-resistant steel of the present disclosure, hardness (HB) and impact absorption energy (J)

may satisfy the following relationship 2. The present disclosure is characterized by improving low-temperature toughness characteristics in addition to high hardness. In this case, the present disclosure may satisfy the following relationship 2. For example, when only the surface hardness is high and the impact toughness is deteriorated and does not satisfy the relationship 2, or the impact toughness is excellent, the surface hardness does not reach the target value, and the relationship 2 is not satisfied, final target high hardness and low temperature toughness characteristics may not be secured.

$$HB \times J \geq 25000 \quad \text{[Relationship 2]}$$

Where, HB represents a surface hardness of the steel measured by Brinell hardness, and J represents a shock absorption energy value at −40° C.

Hereinafter, a method for producing wear-resistant steel according to another embodiment in the present disclosure will be described in detail.

First, a steel slab may be heated at a temperature ranging from 1050 to 1250° C. When the temperature during the heating is lower than 1050° C., re-solid solution of Nb or the like may be insufficient. When the temperature exceeds 1250° C., austenite grains may be coarsened, and thus an ununiform structure may be formed. Therefore, according to an embodiment in the present disclosure, the heating may be performed in a temperature range of 1050 to 1250° C. when heating the steel slab.

The heated steel slab may be rough-rolled in a temperature range of 950 to 1050° C. to manufacture a rough-rolled bar. When the temperature during rough-rolling is less than 950° C., the rolling load may be increased and relatively weakly pressed, such that the deformation may be not sufficiently applied to the center of the slab in a thickness direction, and thus, defects such as pores may not be removed. When the temperature exceeds 1050° C., the grains may grow after the recrystallization occurs at the same time as rolling, and thus, initial austenite grains may become significantly coarse.

The rough-rolled bar may be finish-rolled in a temperature range of 850 to 950° to obtain a hot-rolled steel sheet. When the finish-rolling temperature is less than 850° C., there may be a possibility that ferrite may be formed in the microstructure due to two-phase region rolling. When the finish-rolling temperature exceeds 950° C., the final grain size may become coarse and low-temperature toughness may be deteriorated.

Thereafter, the hot-rolled steel sheet may be air-cooled to room temperature, and may be then reheated at a temperature range of 880 to 930° C. for at least 1.3t+10 minutes (t: plate thickness). The reheating may be to perform reverse transformation of a hot-rolled steel sheet composed of ferrite and pearlite into an austenite single phase. When the reheating temperature is less than 880° C., austenitization may not be sufficiently achieved, and coarse soft ferrite may be mixed, to deteriorate hardness of the final product. When the temperature exceeds 930° C., austenite crystal grains may become coarse and have an effect of increasing quenching properties, and low-temperature toughness of the steel may be deteriorated. When the reheating time is less than 1.3t+10 minutes (t: plate thickness) during the reheating, austenitization does not occur sufficiently, such that phase transformation by rapid cooling, e.g., martensite structure may not be sufficiently obtained. An upper limit of the reheating time during the reheating may be 1.3t+60 minutes (t: plate thickness). When the upper limit of the reheating time exceeds 1.3t+60 minutes (t: plate thickness), austenite crystal grains may become coarse and have an effect of increasing quenching properties, and low-temperature toughness of the steel may be deteriorated.

The reheated and hot-rolled steel sheet may be water-cooled to 150° C. or lower, based on a central portion of the plate thickness (for example, ½ t point (t: a plate thickness (mm)). The water-cooling rate may be 2° C./s or more. When the water-cooling rate is less than 2° C./s or the cooling end temperature exceeds 150° C., a ferrite phase or excessive bainite phase may be formed during cooling. In the present disclosure, an upper limit of the cooling rate is not particularly limited. A technician can set appropriately in consideration of facility limitations. The cooling rate during water-cooling is more preferably 5° C./s or more, and even more preferably 7° C./s or more.

The hot-rolled steel sheet of the present disclosure subjected to the above process conditions may be a thick steel sheet having a thickness of 60 mm or less, more preferably 5 to 50 mm, and even more preferably 5 to 40 mm. In the present disclosure, a tempering process may not be performed on the thick steel sheet.

Hereinafter, embodiments in the present disclosure will be described in more detail. It should be noted, however, that the following embodiments may be intended to illustrate the present disclosure in more detail and not to limit the scope of the present disclosure. The scope of the present disclosure may be determined by the matters set forth in the claims and the matters reasonably inferred therefrom.

MODE FOR INVENTION

Embodiment

After steel slabs having alloy compositions shown in Table 1 were prepared, the steel slabs were subjected to a process of [heating-rough-rolling-hot-rolling-cooling (room temperature)-reheating-water-cooling], to manufacture a hot-rolled steel sheet. A microstructure, a martensite packet size, and mechanical properties of the hot-rolled steel sheet were measured, and the results were shown in Table 3 below.

In the microstructure, specimen was prepared by cutting to a required size to produce a polished surface, followed by etching using a Nital etching solution. Then, a ½t (mm) position in the center of the microstructure in the thickness direction were observed, using an optical microscope and a scanning electron microscope.

The hardness and toughness were measured using a Brinell hardness tester (load 3000 kgf, a tungsten indenter having a diameter of 10 mm) and a Charpy impact tester. In this case, the surface hardness may be an average value of three measurements after milling 2 mm of a plate surface. The section hardness may be an average value of three measurements at the center, for example, a ½t position, of the plate in a thickness direction, after cutting the specimen in the thickness direction of the plate. In addition, the Charpy impact test results were obtained by taking an average of three measurements at −40° C. after taking the specimen from a ¼t position.

TABLE 1

| | Alloy Composition (Wt %) | | | | | | | | | | |
|---|---|---|---|---|---|---|---|---|---|---|---|
| | C | Si | Mn | P | S | Al | Cr | Ni | Cu | Mo | B |
| CS1 | 0.177 | 0.35 | 1.67 | 0.012 | 0.0031 | 0.031 | 0.65 | 1.14 | 0.05 | 0.11 | 0.0015 |
| CS2 | 0.254 | 0.38 | 0.85 | 0.008 | 0.0012 | 0.035 | 0.07 | 0.25 | 0.15 | 0.13 | 0.0002 |
| CS3 | 0.342 | 0.21 | 0.72 | 0.011 | 0.0009 | 0.023 | 0.84 | 0.91 | 0.06 | 0.31 | 0.0012 |
| CS4 | 0.270 | 0.31 | 1.51 | 0.007 | 0.0013 | 0.026 | 0.45 | 0.58 | 0.10 | 0.49 | 0.0018 |
| IS1 | 0.215 | 0.25 | 0.85 | 0.007 | 0.0020 | 0.026 | 0.28 | 1.57 | 0.21 | 0.36 | 0.0016 |
| IS2 | 0.248 | 0.30 | 1.38 | 0.008 | 0.0018 | 0.024 | 0.19 | 1.29 | 0.34 | 0.25 | 0.0022 |
| IS3 | 0.263 | 0.31 | 1.37 | 0.007 | 0.0020 | 0.025 | 0.11 | 2.64 | 0.17 | 0.10 | 0.0020 |

| | Alloy Composition (Wt %) | | | | | | | | |
|---|---|---|---|---|---|---|---|---|---|
| | Co | Ti | Nb | V | Ca | As | Sn | W | Relationship |
| CS1 | — | 0.014 | 0.041 | 0.01 | 0.0002 | — | — | — | 0.0101 |
| CS2 | — | 0.017 | 0.017 | 0.05 | 0.0004 | — | — | — | 0.0095 |
| CS3 | — | 0.006 | 0.006 | 0.03 | 0.0010 | — | — | — | 0.0187 |
| CS4 | 0.01 | 0.016 | 0.016 | 0.08 | 0.0009 | 0.003 | 0.003 | 0.01 | 0.0157 |
| IS1 | 0.01 | 0.003 | 0.003 | 0.01 | 0.0005 | 0.003 | 0.004 | 0.01 | 0.0709 |
| IS2 | 0.01 | 0.015 | 0.015 | 0.01 | 0.0012 | 0.002 | 0.004 | — | 0.1088 |
| IS3 | 0.01 | 0.014 | 0.014 | 0.01 | 0.0003 | 0.003 | 0.003 | — | 0.1180 |

[Relationship 1] C × Ni × Cu (where the contents of C, Ni, and Cu are based on wt %).

TABLE 2

| | Steel No. | Slab Heating Temp. (° C.) | Rough Rolling Temp. (° C.) | Finish Rolling Temp. (° C.) | Reheating Temp. (° C.) | Reheating Furnace Time (minute) | Cooling Rate (° C./s) | Cooling End Temp. (° C.) | Thickness (mm) |
|---|---|---|---|---|---|---|---|---|---|
| CE1 | CS1 | 1068 | 965 | 820 | 912 | 25 | 32.5 | 130 | 10 |
| CE2 | | 1131 | 1084 | 961 | 860 | 38 | 24.6 | 75 | 20 |
| CE3 | | 1142 | 985 | 934 | 935 | 62 | 11.3 | 43 | 40 |
| CE4 | CS2 | 1132 | 1050 | 945 | 906 | 35 | 32.5 | 35 | 19 |
| CE5 | | 1165 | 979 | 943 | 868 | 48 | 23.1 | 26 | 25 |
| CE6 | | 1127 | 975 | 948 | 899 | 49 | 11.1 | 129 | 28 |
| CE7 | CS3 | 1155 | 1002 | 915 | 900 | 37 | 26.9 | 36 | 20 |
| CE8 | | 1124 | 986 | 913 | 902 | 59 | 16.7 | 138 | 35 |
| CE9 | | 1130 | 977 | 936 | 901 | 65 | 7.4 | 24 | 40 |
| CE10 | CS4 | 1271 | 1067 | 926 | 866 | 21 | 35.5 | 323 | 12 |
| CE11 | | 1169 | 988 | 944 | 891 | 38 | 24.4 | 17 | 20 |
| CE12 | | 1157 | 990 | 947 | 917 | 116 | 13.1 | 18 | 35 |
| IE1 | IS1 | 1125 | 1041 | 894 | 910 | 31 | 54.0 | 27 | 15 |
| IE2 | | 1123 | 1017 | 925 | 908 | 48 | 34.4 | 32 | 25 |
| CE13 | | 1164 | 980 | 944 | 839 | 72 | 13.1 | 255 | 45 |
| CE14 | IS2 | 1150 | 1034 | 912 | 988 | 48 | 41.4 | 29 | 20 |
| IE3 | | 1142 | 1010 | 935 | 901 | 65 | 25.8 | 27 | 40 |
| IE4 | | 1138 | 987 | 944 | 913 | 80 | 15.1 | 22 | 50 |
| IE5 | IS3 | 1119 | 1027 | 868 | 921 | 27 | 47.8 | 31 | 10 |
| IE6 | | 1134 | 997 | 936 | 916 | 58 | 23.4 | 30 | 35 |
| IE7 | | 1125 | 968 | 938 | 925 | 92 | 12.5 | 19 | 60 |

IE: Inventive Example,
CE: Comparative Example,
IS: Inventive Steel,
CS: Comparative Steel

TABLE 3

| | Microstructure (area %) | | Martensite Packet Size | Surface Hardness | Impact Toughness (J, | Relationship |
|---|---|---|---|---|---|---|
| | Martensite | Bainite | (μm) | (HB) | @−40° C.) | 2 |
| CE1 | 96 | 4 | 22.1 | 449 | 67 | 30083 |
| CE2 | 97 | 3 | 24.6 | 432 | 58 | 25056 |
| CE3 | 99 | 1 | 20.3 | 451 | 71 | 32021 |
| CE4 | 100 | 0 | 13.5 | 514 | 30 | 15420 |
| CE5 | 96 | 4 | 13.2 | 520 | 21 | 10920 |
| CE6 | 99 | 1 | 13.4 | 516 | 22 | 11352 |

TABLE 3-continued

| | Microstructure (area %) | | Martensite Packet Size | Surface Hardness | Impact Toughness (J, | Relationship |
|---|---|---|---|---|---|---|
| | Martensite | Bainite | (μm) | (HB) | @−40° C.) | 2 |
| CE7 | 100 | 0 | 7.7 | 572 | 13 | 7436 |
| CE8 | 98 | 2 | 8.0 | 586 | 9 | 5274 |
| CE9 | 98 | 2 | 7.9 | 580 | 15 | 8700 |
| CE10 | 92 | 8 | 9.6 | 487 | 37 | 18019 |
| CE11 | 99 | 1 | 9.8 | 528 | 20 | 10560 |
| CE12 | 98 | 2 | 10.0 | 520 | 21 | 10920 |
| IE1 | 99 | 1 | 12.4 | 481 | 86 | 41366 |
| IE2 | 100 | 0 | 12.5 | 490 | 70 | 34300 |
| CE13 | 93 | 7 | 11.9 | 435 | 63 | 27405 |
| CE14 | 100 | 0 | 14.3 | 509 | 42 | 21378 |
| IE3 | 100 | 0 | 11.7 | 502 | 56 | 28112 |
| IE4 | 99 | 1 | 11.9 | 521 | 51 | 26571 |
| IE5 | 100 | 0 | 10.2 | 519 | 88 | 45672 |
| IE6 | 99 | 1 | 10.1 | 525 | 82 | 43050 |
| IE7 | 100 | 0 | 10.6 | 517 | 78 | 40326 |

[Relationship 2]

HB × J

Where, HB represents a surface hardness of the steel measured by Brinell hardness, and J represents a shock absorption energy value at −40° C.

IE: Inventive Example,

CE: Comparative Example,

IS: Inventive Steel,

CS: Comparative Steel

As can be seen from Tables 1 to 3 above, in the case of Inventive Examples 1 to 7, which satisfy the alloy composition, relationship 1, and the manufacturing conditions, proposed by the present disclosure, it can be seen that the microstructure fraction of the present disclosure and the martensite packet size were satisfied, and excellent hardness and low-temperature impact toughness were secured.

In the case of Comparative Examples 1, 2, 3, 5, 10, and 12, which do not satisfy the alloy composition or relationship 1, proposed by the present disclosure, and also do not satisfy the manufacturing conditions proposed by the present disclosure, it can be seen that hardness and low-temperature impact toughness did not reach the levels targeted by the present disclosure. In addition, it can be seen that the surface hardness was low because the martensite packet sizes of Comparative Examples 1 to 3 were not satisfied.

In addition, in the case of Comparative Examples 4, 6, 7, 8, 9, and 11, which satisfy the manufacturing conditions proposed by the present disclosure, but do not satisfy the alloy composition or relationship 1 proposed by the present disclosure, it can be seen that excellent hardness and low-temperature impact toughness are not secured.

In the case of Comparative Examples 13 and 14, which satisfy the alloy composition and relationship 1 proposed by the present disclosure, but do not satisfy the reheating temperature or the cooling end temperature among the manufacturing conditions proposed by the present disclosure, it can be seen that hardness and low-temperature impact toughness did not reach the levels targeted by the present disclosure.

The invention claimed is:

1. Wear-resistant steel having hardness and impact toughness, comprising, by weight, carbon (C): 0.19 to 0.28%, silicon (Si): 0.1 to 0.7%, manganese (Mn): 0.6 to 1.6%, phosphorus (P): 0.05% or less, excluding 0%, sulfur (S): 0.02% or less, excluding 0%, aluminum (Al): 0.07% or less, excluding 0%, chromium (Cr): 0.01 to 0.5%, nickel (Ni): 0.01 to 3.0%, copper (Cu): 0.01 to 1.5%, molybdenum (Mo): 0.01 to 0.5%, boron (B): 50 ppm or less, excluding 0%, arsenic (As): 0.002 to 0.05% and cobalt (Co): 0.01 to 0.02%, further comprising one or more selected from the group consisting of titanium (Ti): 0.02% or less, excluding 0%, niobium (Nb): 0.05% or less, excluding 0%, vanadium (V): 0.05% or less, excluding 0%, and calcium (Ca): 2 to 100 ppm, and comprising a remainder of iron (Fe) and other unavoidable impurities, wherein C, Ni, and Cu satisfy the following relationship 1, wherein a microstructure includes 95 area % or more of martensite, and wherein the steel has a hardness of 460 to 540 HB, and an impact absorption energy of 47 J or more at −40° C., where, the HB represents a surface hardness of the steel measured by Brinell hardness:

$$C \times Ni \times Cu \geq 0.05 \qquad \text{Relationship 1}$$

Where the contents of C, Ni, and Cu are based on wt %.

2. The wear-resistant steel according to claim 1, further comprising one or two of tin (Sn): 0.05% or less, excluding 0%, and tungsten (W): 0.05% or less, excluding 0%.

3. The wear-resistant steel according to claim 1, further comprising 5 area % or less of bainite.

4. The wear-resistant steel according to claim 1, wherein the martensite has an average packet size of 20 μm or less.

5. The wear-resistant steel according to claim 1, wherein the hardness (HB) and impact absorption energy (J) satisfy the following relationship 2: $HB \times J \geq 25000$ Relationship 2 where, HB represents a surface hardness of the steel measured by Brinell hardness, and J represents a shock absorption energy value at −40° C.

6. A method for producing wear-resistant steel having hardness and impact toughness, comprising:

heating a steel slab at a temperature ranging from 1050 to 1250° C., the steel slab comprising, by weight, carbon (C): 0.19 to 0.28%, silicon (Si): 0.1 to 0.7%, manganese (Mn): 0.6 to 1.6%, phosphorus (P): 0.05% or less, excluding 0%, sulfur (S): 0.02% or less, excluding 0%, aluminum (Al): 0.07% or less, excluding 0%, chromium (Cr): 0.01 to 0.5%, nickel (Ni): 0.01 to 3.0%, copper (Cu): 0.01 to 1.5%, molybdenum (Mo): 0.01 to 0.5%, boron (B): 50 ppm or less, excluding 0%, arsenic (As): 0.002 to 0.05%, and cobalt (Co): 0.01 to 0.02%, further comprising one or more selected from the group consisting of titanium (Ti): 0.02% or less, excluding 0%, niobium (Nb): 0.05% or less, excluding 0%, vanadium (V): 0.05% or less, excluding 0%, and calcium (Ca): 2 to 100 ppm, and comprising a remainder of iron (Fe) and other unavoidable impurities, wherein C, Ni, and Cu satisfy the following relationship 1;

rough-rolling the reheated heated steel slab, in a temperature range of 950 to 1050° C. to obtain a rough-rolled bar;

finish-rolling the rough-rolled bar in a temperature range of 850 to 950° C. to obtain a hot-rolled steel sheet;

air-cooling the hot-rolled steel sheet to room temperature, and then, reheating the hot-rolled steel sheet at a temperature ranging from 880 to 930° C. in a furnace time of 1.3t+10 minutes to 1.3t+60 minutes (t: a plate thickness); and water-cooling the reheated and hot-rolled steel sheet to 150° C. or lower, and wherein the steel has a hardness of 460 to 540 HB, and a impact absorption energy of 47 J or more at −40° C., where, the HB represents a surface hardness of the steel measured by Brinell hardness: $C \times Ni \times Cu \geq 0.05$ Relationship 1

Where the contents of C, Ni, and Cu are based on wt %.

7. The method according to claim 6, wherein the steel slab further comprises one or two of tin (Sn): 0.05% or less, excluding 0%, and tungsten (W): 0.05% or less, excluding 0%.

8. The method according to claim 6, wherein the water-cooling has a cooling rate of 2° C./s or more.

* * * * *